United States Patent [19]

Gorsky et al.

[11] 4,172,359

[45] Oct. 30, 1979

[54] TIMEPIECE WITH ELECTRONIC CHIME GENERATOR

[75] Inventors: Egon Gorsky, 306 W. Dudley Ave., Westfield, N.J. 07090; Morse Minknow, Bronx, N.Y.

[73] Assignee: Egon Gorsky

[21] Appl. No.: 588,443

[22] Filed: Jun. 19, 1975 (Under 37 CFR 1.47)

[51] Int. Cl.[2] ..... G04C 3/00; G04B 21/08; G08B 3/00

[52] U.S. Cl. ..... 58/23 R; 58/14; 58/38 R; 340/384 E

[58] Field of Search ..... 58/12, 13, 14, 21.12, 58/23 R, 38 R, 39.5, 60, 126 C, 130 E; 340/384 E

[56] References Cited

U.S. PATENT DOCUMENTS

| | | | |
|---|---|---|---|
| 3,420,051 | 1/1969 | Matteson | 58/14 |
| 3,438,195 | 4/1969 | Cochin | 58/126 C |
| 3,759,029 | 9/1973 | Komaki | 58/38 |

*Primary Examiner*—E. S. Jackmon
*Attorney, Agent, or Firm*—Caesar, Rivise, Bernstein & Cohen, Ltd.

[57] ABSTRACT

A quarter hour and hour tone generator system for generating sequences of tones on the quarter hour and hour intervals. The system includes a timepiece having output means for providing a coded representation of time, means responsive to the output means for initiation of the tone generator each time the timepiece reaches a quarter hour interval. Gating means are provided for selecting a sequence of tones in accordance with the time represented by the output means. Instantaneous chime readout capability is also provided to enable en audible indication of the most recently passed quarter hour.

14 Claims, 10 Drawing Figures

POWER AND CLEARING CONTROL

CLOCK, COMPARATOR, HOUR COUNTER & CHIME CONTROL

FIG. 4
TIMING CONTROL
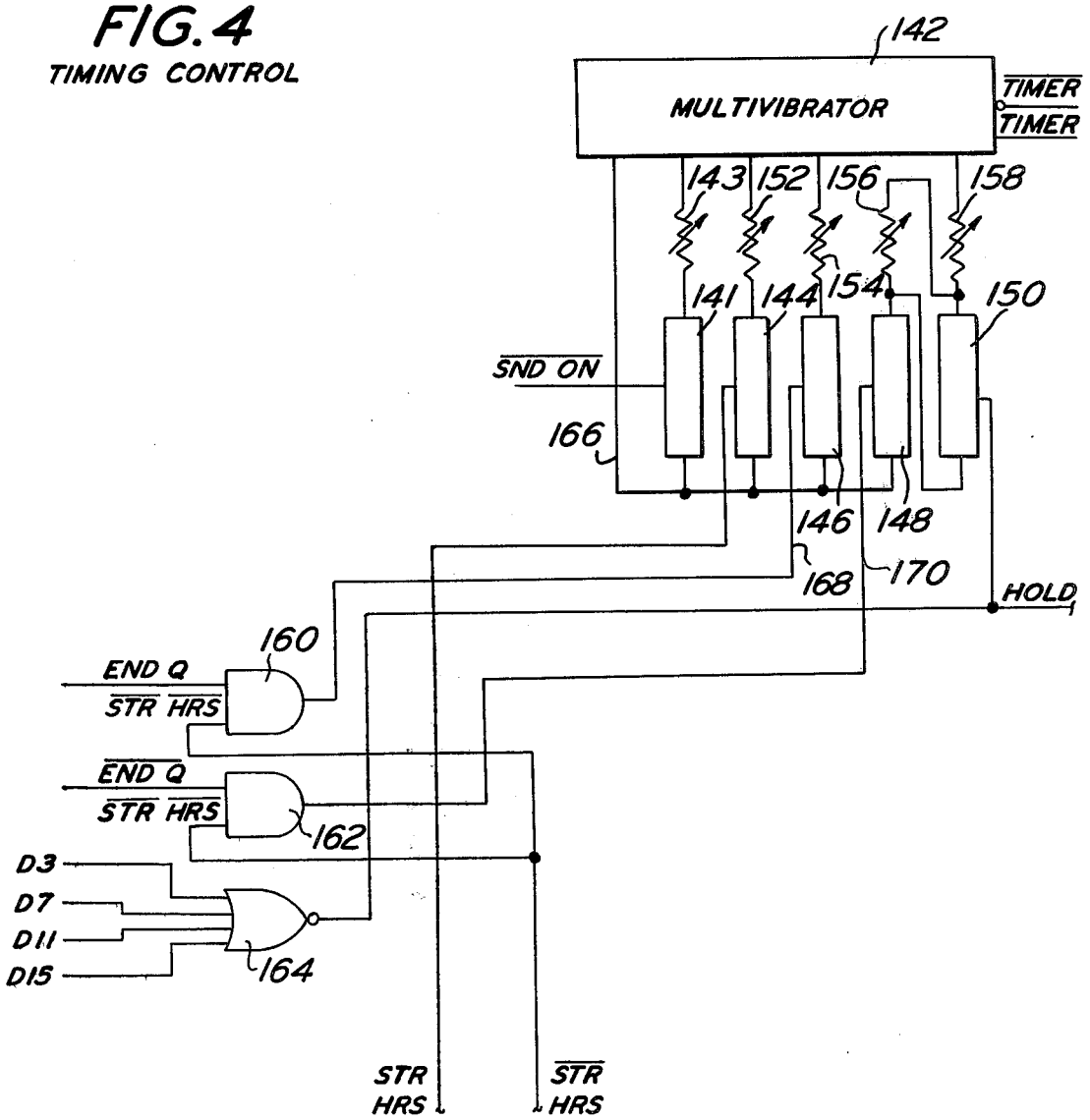
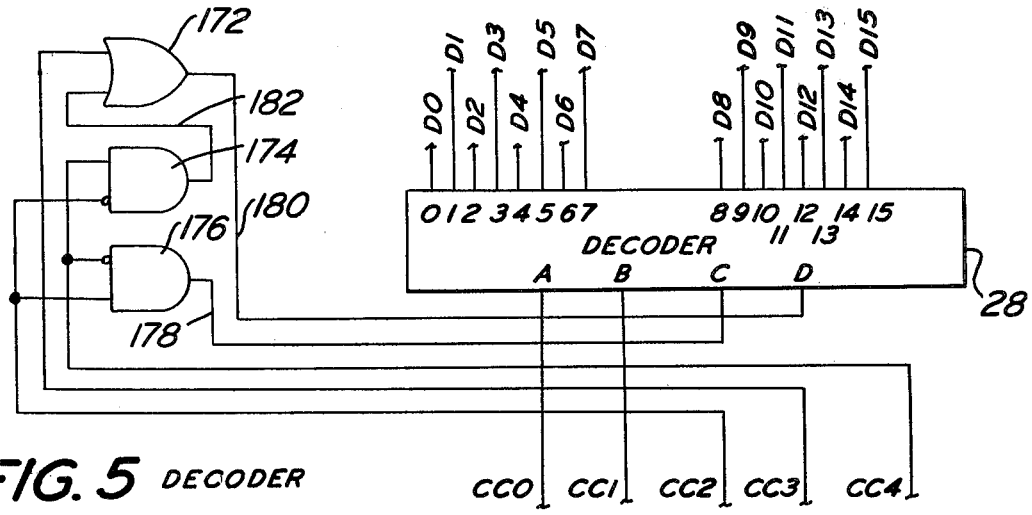
FIG. 5 DECODER

SOUND CONTROL

TONE SELECTION CKTS.

FIG. 8
TONE GENERATOR
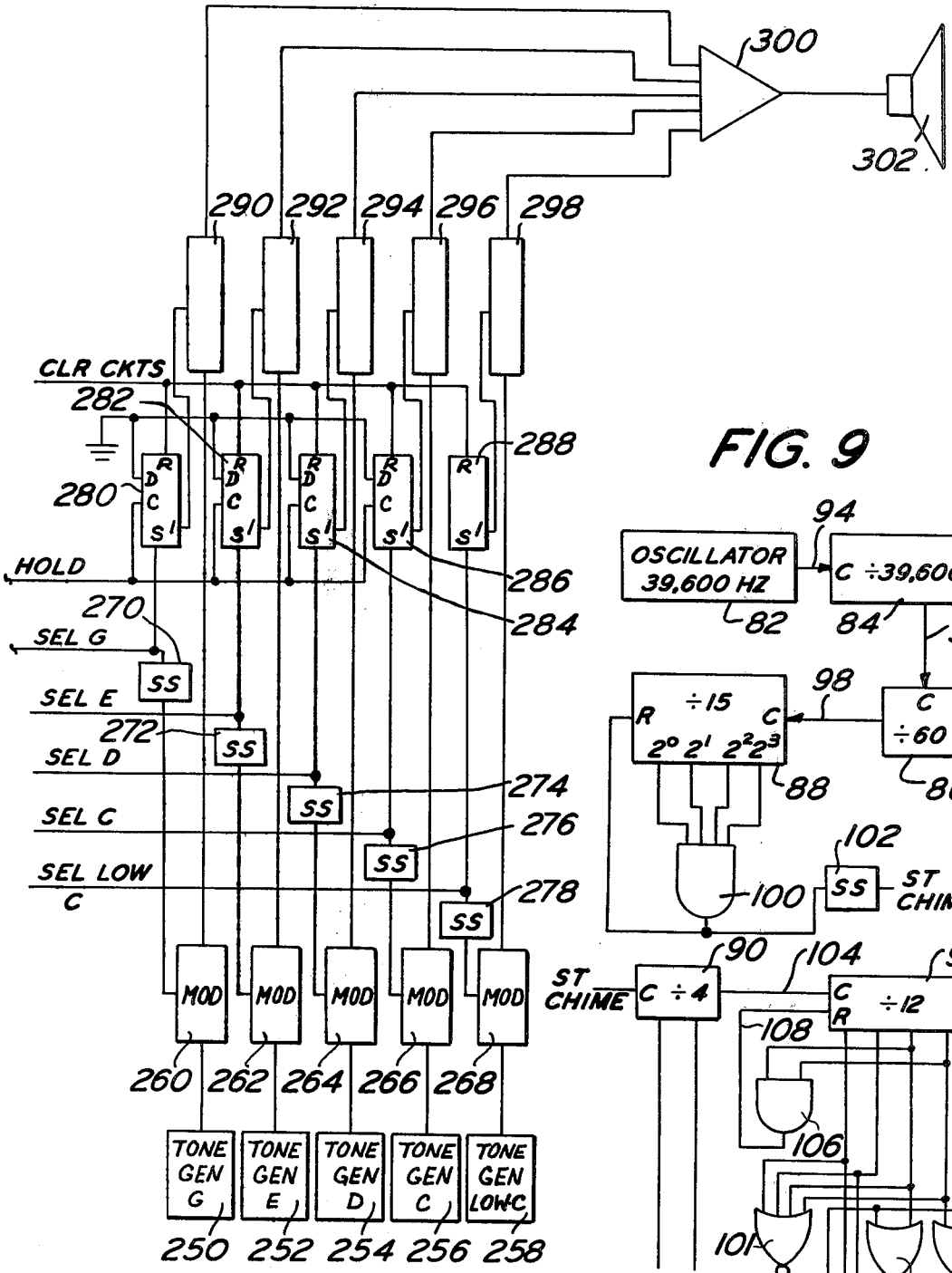
FIG. 9
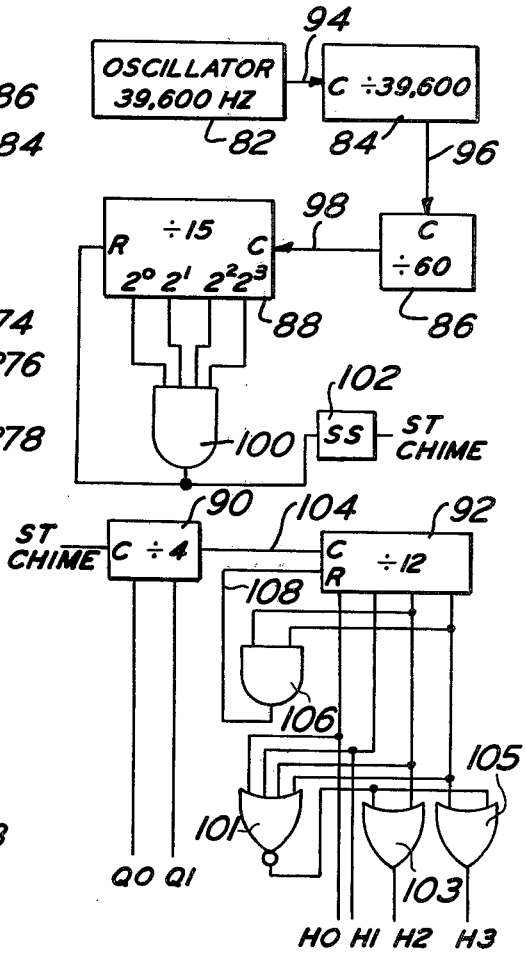
FIG. 10

TIMEPIECE WITH ELECTRONIC CHIME GENERATOR

This invention relates generally to timepieces and more particularly to a timepiece having a quarter hour and hour tone generator to simulate mechanical chime movements.

Timepieces having chimes which are generated at each quarter hour are very soothing to the ethereal senses of many people. One of the more popular sequences of tones, known as the Westminster Chimes, are produced by an elaborate mechanical chime movement which is, of course, very expensive to produce. In the Westminster Chime movement, at the first quarter hour interval of the clock (15 minutes past the hour) four tones are struck in a predetermined sequence. At the second quarter hour interval (30 minutes past the hour) two sets of four notes in a predetermined sequence are generated. During the third quarter hour interval (45 minutes past the hour) three sets of four notes are provided in a predetermined sequence. At the fourth quarter hour (at the hour) four sets of four tones in a predetermined sequence are generated followed by a chime for each hour past 12 o'clock. That is, if the clock strikes 3 o'clock, there will be four sets of four tones in sequence generated, followed by three chimes indicative of the time 3 o'clock.

Because it is extremely expensive to purchase the mechanical chime movements that produce the Westminster chimes, the availability of the Westminster chime movement is dwindling. The number of companies that produce the chimes throughout the world has steadily decreased in view of the fact that the prices that must be charged for the same is considerable. The prices are thereby driving out of the market for these chime movements a large percentage of consumers that cannot afford such a unit.

It is therefore an object of the invention to overcome the aforementioned problem in production of quarter hour and hour tone generators.

Another object of the invention is to provide a new and improved quarter hour and hour tone generator for use with clocks which is inexpensive to manufacture, yet which produces a high quality chime.

Still another object of this invention is to provide an electronic chime movement which is of a smaller size than equivalent mechanical chime movements so that said chime feature can be provided with time pieces of smaller size.

Yet another object of the invention is to provide a new and improved quarter hour and hour tone generator for a timepiece which utilizes electronic simulation of sound and digital techniques for generating sequences of tones in accordance with the time as indicated on said timepiece.

These and other objects of the invention are achieved by providing a quarter hour and hour tone generator system for generating sequences of tones on the quarter hour and hour intervals. The system includes a timepiece having output means for providing a coded representation of time and means responsive to the output means for initiation of the tone generator each time the timepiece reaches a quarter hour interval. Gating means are provided for selecting a sequence of tones in accordance with the time represented by the output means. Instantaneous chime readout is also provided for providing an indication of the time to the most recently passed quarter hour interval.

Other objects and many of the attendant advantages of this invention will be readily appreciate as the same becomes better understood by reference to the following detailed description when considered in connection with the accompanying drawing wherein:

FIG. 4 is a schematic block diagram of the timing control;

FIG. 5 is a schematic block diagram of the decoder;

FIG. 8 is a schematic block diagram of the tone generator and the audio output;

FIG. 9 is a schematic block diagram of a preferred time interval generator; and FIG. 10 is a schematic block diagram of a preferred time indicator.

Figure 1:
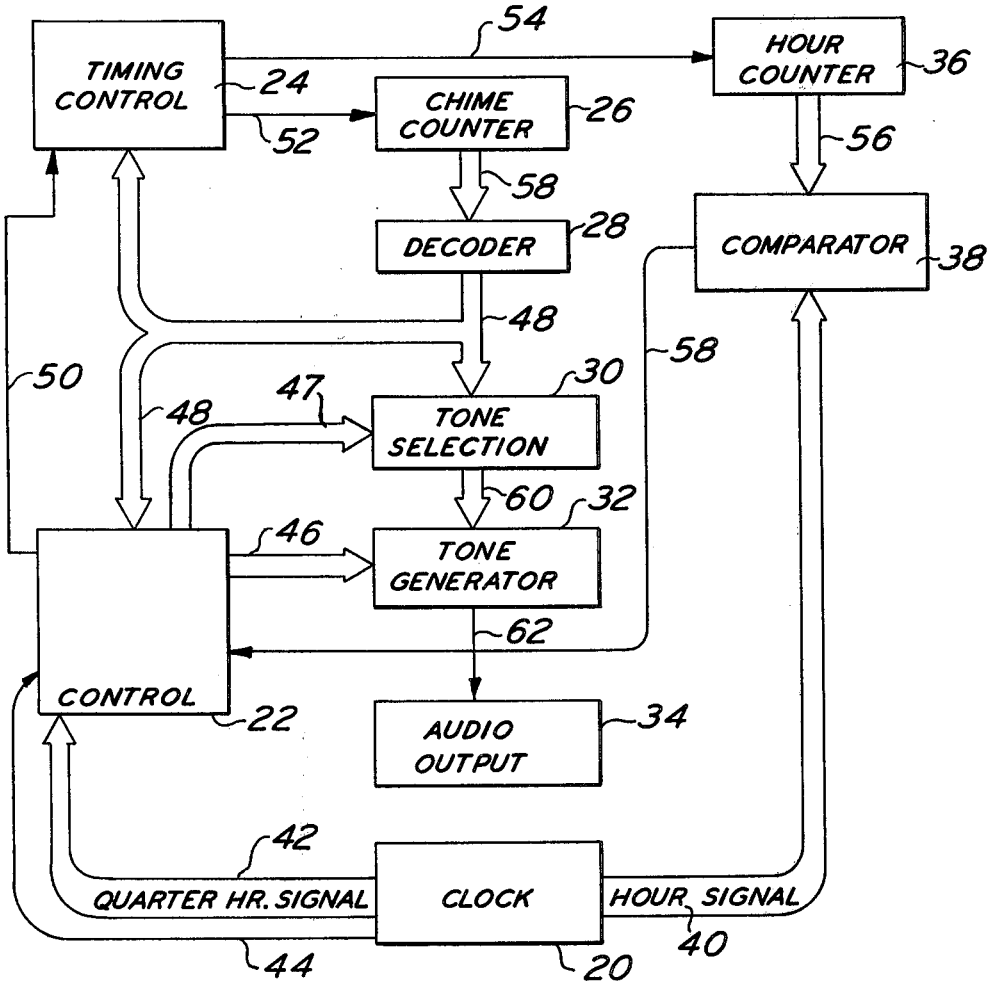
FIG. 1 is a schematic block diagram of a quarter hour and hour tone generator embodying the invention in combination with a clock.

Referring now in greater detail to the various figures of the drawing wherein like reference numerals refer to like parts, a timepiece with an electronic chime generator which generates sequences of tones at each quarter of an hour and hour embodying the invention is shown generally therein in FIG. 1. It should be noted that the system is shown in more specific detail in FIGS. 2 through 10 and that FIG. 1 does not include a few interconnections between the various components to facilitate the overall description of the invention. The interconnections are shown in FIGS. 2 through 10. The system includes a timepiece or clock 20, control unit 22, timing control 24, a chime counter 26, a decoder 28, tone selection circuitry 30, a tone generator 32, an audio output 34, an hour counter 36 and a comparator 38. The clock 20 is drawn as a single unit to simplify the schematic representation. It represents equipment that performs two types of functions. The first is that of a time interval generator that produces output signals at the end of specific time intervals. The second function is that of a time of day indicator which responds to the output of the time interval generator to produce outputs indicating the time of day in hours and quarters of an hour.

In the preferred embodiment the clock 20 is one piece of equipment that generates signals at quarter hour time intervals, as well as output signals indicating the time of day in hours and quarter hours.

Where the time of day indicator part is of the mechanical type, it includes a shaft converter which provides a binary coded representation of the time in hours and quarters of an hour. That is, a disc is preferably provided which converts the position of the hour shaft into a digital representation of the time. The digital representation of the hour signal is provided on output lines 40 and the quarter hour representation is provided on output lines 42. Where an electronic clock is provided, the output of the counters comprising the clock include binary outputs which are taken directly off for providing hour signals on output lines 40 and quarters of an hour on output line 42. The output lines 40 of clock 20 are connected to comparator 38 and the output lines 42 are connected to the control 22. In addition, the clock 20 includes an output line 44 which is used to carry the output signal from clock 20 which is generated every fifteen minutes on each of the quarters of an hour. That is, an output signal is generated on line 44 at each quarter past the hour, each half hour past the hour, each third quarter past the hour and upon each hour. Line 44 is also connected to the control 22. Most timepieces or timing means perform one or more of the functions described for the clock 20. Therefore, most timepieces or timing means can be easily integrated into the quarter hour and hour tone generating system by connecting suitable outputs from it to the remainder of the system.

The control 22 basically comprises various control circuits for operating the circuitry. The control circuitry 22 is connected via output lines 46 to tone generator 32 and via output lines 47 to the tone selection circuitry 30. The decoder output lines 48 are also connected to the control 22. The control 22 is connected via a power line 50 to the timing control 24. The timing control 24 is connected to the chime counter 26 via line 52 and to the hour counter 36 via line 54. The timing control 24 comprises a timing device for generating pulses which control the time interval between the steps in the sequence of counts which are then used to control the timing of a sequence of tones.

The hour counter 36 is connected via its output lines 56 to comparator 38. The hour counter 36 is used to count the number of timing pulses provided on line 54 from the timing control to determine the number of hour chimes that have been generated by the tone generator 32 and converted into chime sounds by the audio output 34. The comparator 38 which receives input signals from lines 40 and 56 from the clock and hour counter, respectively, compare the signals provided on lines 40 and 56 to provide an output signal on line 58 when the signals on lines 56 and 40 are equal. The output line 58 is connected to control 22 which turns off the timing control when the signals on line 56 equal the signals on line 40.

In operation, at each fifteen minute interval, a pulse is generated on line 44 from the clock 20. When the pulse is provided to the control 22, control 22 provides an enabling signal on line 50 to start timing control 24 and also provides to the tone generator, via lines 46, enabling signals to enable operation of the tone generator 32. It should be noted that turning on the timing control and the tone generator only during the intervals that the sequences of chimes are generated, acts to save considerably the amount of energy expended in the operation of the circuitry.

Accordingly, where the system is portable, or is operated by a battery or other portable source of energy, the operation of the tone generator and clock continue for a long period of time without the requirement of replacement of the portable energy source.

When the timing control is turned on, the timing control 24 generates a sequence of pulses on line 52 to the chime counter 26. The chime counter 26 is connected via output lines 58 to the decoder 28. The lines 58 are connected to each of the stages of the chime counter to provide a binary representation of the count in the chime counter. The count from the chime counter is thus fed to the decoder 28 which converts the count into a one out of N output on lines 48 which are connected to the tone selection unit 30.

The tone selection unit 30 includes a plurality of gates which are utilized to select various tones in accordance with the output line of the decoder 28 that is pulsed. The tone selection unit is connected via output lines 60 to the tone generator 32. The tone generator 32 generates various tones in accordance with the tone selection signals provided on line 60 and the tones are modulated in accordance with signals provided on lines 46 from the control 22. The signals from the tone generator are provided on line 62 to the audio output 34, which preferably comprises a speaker which converts the electronic signals on line 62 to a sound output.

Each time the clock has reached a quarter hour position, a pulse is provided on line 44 to initiate the generation of a sequence of tones which are modified by the audio output and the control 22 to provide a series of sounds which simulate very closely the sound of chimes.

During the first quarter of an hour, past the hour, a first sequence of four tones are generated whereupon the control 22 turns off the tone generating unit. After the second quarter of an hour past the hour, two sets of four note sequences are generated, whereupon the control 22 turns off the tone generating unit. After the third quarter of an hour past the hour, the tone generator generates three sequences of four tones, whereupon the unit is turned off. At the hour, the signal provided on line 44 which causes the control 22 to turn on the entire unit, causes the tone generator to produce four sequences of four tones, followed by a chime for each hour past 12 o'clock. Thus, the timing control unit 24 steps the hour counter until the hour counter reaches the count for the same time that is presently indicated by clock 20 via output lines 40. As soon as the same number of hours have been counted in hour counter 36 that are provided in number via output lines 40, the comparator 38 provides a pulse on line 58 to indicate that the number of hours is equal in both the hour counter and the clock 20, thereby turning off the unit and preventing any further hour chimes.

Figure 2:
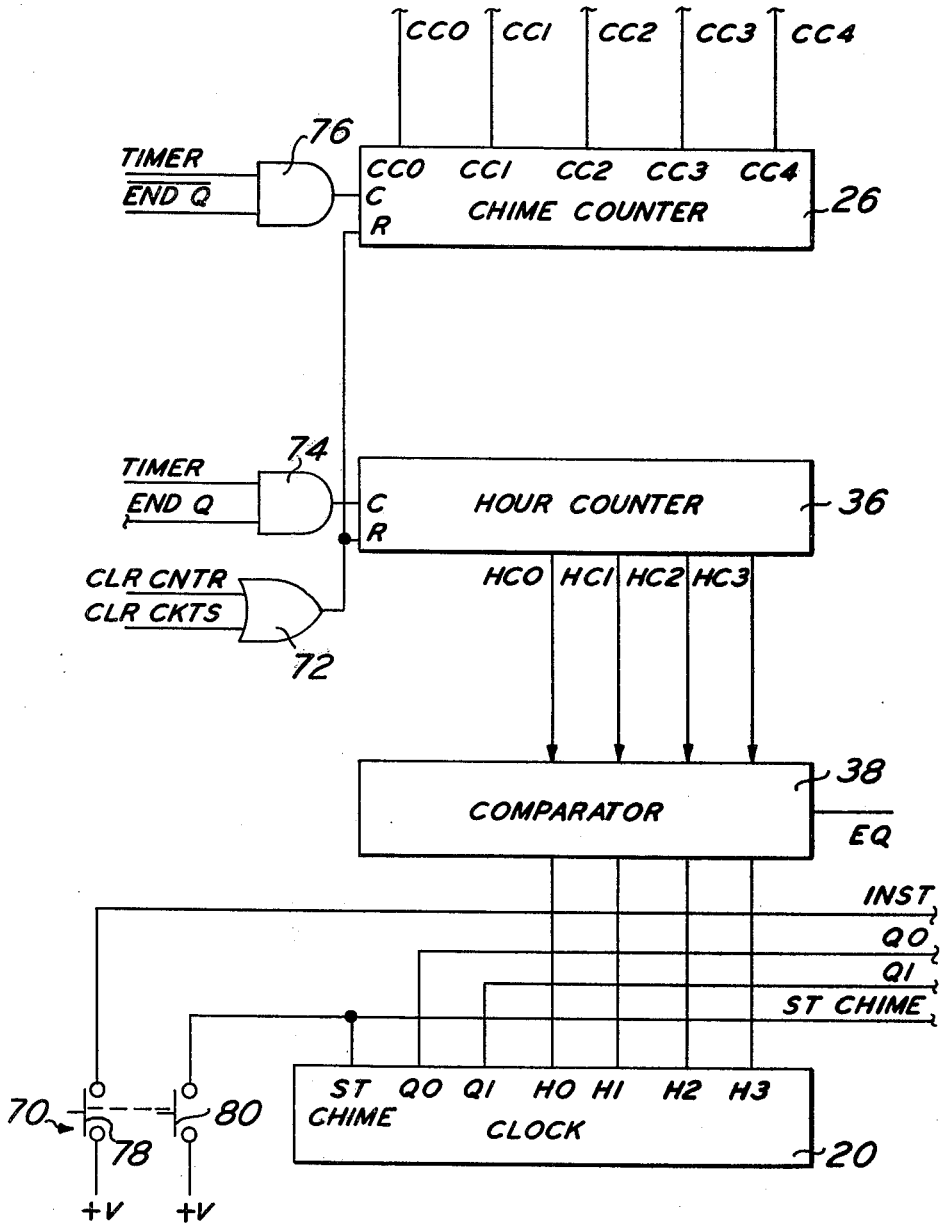
FIG. 2 is a schematic block diagram of the interconnections between the clock, comparator, hour counter and chime counter.

The interconnection between the clock, comparator hour counter and chime counter is shown in FIG. 2. In addition to the clock 20, the comparator 38, the hour counter 36 and the chime counter 26, FIG. 2 shows a push-button switch 70, an OR gate 72, an AND gate 74 and an AND gate 76. The switch 70 is a push-button switch which includes a pair of closing contacts 78 and 80 which connect respectively the source of positive voltage (+V) to the INST line and the ST CHIME line. As will hereinafter be seen, switch 70 enables an instantaneous chime readout each time the push-button 70 is pushed and in accordance with the clock time in clock 20.

A preferred embodiment of clock 20 is shown in FIGS. 9 and 10. FIG. 9 shows a preferred time interval generator for generating output pulses every fifteen minutes. Basically, it comprises a crystal oscillator 82, a counter 84 which divides the number of incoming pulses by 39,600, a counter 86 which divides the number of pulses received at its counter input by sixty, a counter 88 which divides the number of pulses received at its counter input by fifteen. Counters 84, 86 and 88 are preferably binary counters which are appropriately constructed to reset at their appropriate count number. That is, counter 84 provides a carry output pulse at the count of 39,600 as it is reset to zero after 39,600 pulses.

Similarly, counter 86 recycles after sixty pulses and the counter 88 recycles after fifteen pulses. The output of oscillator 82 is connected via line 94 to the count input of counter 84. The output of counter 84 is connected via line 96 to the count input of counter 86 and the output of counter 86 is connected via line 98 to the divide by fifteen counter 88. The counters 84 and 86 act to divide down the number of pulses from the oscillator 82, to provide one pulse per minute on line 98 to the counter 88. The counter 88 preferably comprises a four stage binary counter, with the outputs of each stage being connected to an AND gate 100. When each of the stages are in the one state and provide a high input to each of the four inputs of AND gate 100, the AND gate 100 is enabled, thereby resetting the counter to zero and also providing an input pulse to the single shot multivibrator 102. That is, the output of AND gate 100 is connected to the reset input of counter 88, as well as to an input of the single shot multivibrator 102. The output of single shot multivibrator 102 is provided on the ST CHIME line. The pulse from the single shot multivibrator 102 is thus provided every fifteen minutes since the counter 88 is a minute counter.

A preferred electronic time indicator is shown in FIG. 10. It comprises a divide by four counter 90, a divide by twelve counter 92, AND gate 106, OR gate 101 and OR gates 103 and 105. The output of single shot multivibrator 102 in FIG. 9 is connected to counter 90 via the ST CHIME line. Thus, the number of fiteen minute quarters is counted by the divide by four counter 90, which is a two stage binary counter having each of its stages connected to an output line which are output lines Q0 and Q1, respectively. The output of the counter 90 is connected via line 104 to the count input of divide by twelve counter 92 and, since a pulse is provided each hour on line 104, the divide by twelve counter 92 functions as an hour counter. The counter 92 is preferably a four stage binary counter, each stage of which is connected to one of output lines H0, H1, H2 or H3.

It should be noted that for ease of reference in this application, where outputs are used as in the outputs of binary counters, such as counters 90 and 92, a letter or letters represents the initials of the counter and the numeral represents the power of the stage to which the line is connected. Thus, Q0 and Q1 refer respectively to the $2^0$ and $2^1$ stage of the divide by four counter and H0, H1, H2 and H3 refer respectively to the outputs of the $2^0$, $2^1$, $2^2$ and $2^3$ stages of the divide by twelve counter 92. The counter 92 recycles as soon as it reaches the count of twelve as a result of the interconnection of an AND gate 106, which is connected to the output lines of the $2^2$ and $2^3$ stages of counter 92 at its inputs and the output of which is connected via line 108 to the reset input of the counter 92. The $2^0$, $2^1$, $2^2$ and $2^3$ output lines of counter 92 are each connected to an input of an OR gate 101 having an inverted output which is connected to an input of each of OR gates 103 and 105. The remaining inputs to OR gates 103 and 105 are connected to the outputs of the $2^2$ and $2^3$ stage respectively of the counter 92. Thus, the signals on lines H1, H2, H3 and H4 of the counter 92 represent counts from one to twelve. After the counter 92 has reached the count of eleven, it is reset immediately to zero upon the receipt of the next pulse. However, OR gates 101, 103 and 105 cause the count of zero to be converted to a count of twelve.

In operation, it can therefore be seen that the preferred electronic clock 20 shown in FIG. 9 provides a pulse on the ST CHIME line every fifteen minutes. The Q0 and Q1 bits from the counter 90 in FIG. 10 provide a constant readout of the particular quarter hour represented by clock 20.

Thus, during the first quarter of an hour after the hour, the voltage on lines Q0 and Q1 are both low, thereby representing binary 00 or 0, base 10. After the second quarter hour, the voltage on lines Q0 and Q1 are respectively high and low representing binary 10 or the number 1, base 10. During the third quarter of an hour, the voltages on lines Q0 and Q1 are respectively low and high, representing 01 or the numeral 2, base 10. During the fourth quarter of the hour, both Q0 and Q1 are high, thereby representing the binary 11 or the number 3, base 10.

Similarly, for each hour pulse provided on line 104 to the counter 92, the counter 92 is stepped thereby providing the binary representation of the hours of time on lines H0 through H3. Where the electronic time indicator is utilized as shown in FIG. 10, a digital readout is preferably provided, but is not shown since it forms no part of the invention. Similarly, where a mechanical time indicator is used having a shaft converter disc which provides the equivalent outputs for the Q0, Q1, H0 or H1, H2 and H3 lines, the readout would be the normal clock face used in conventional mechanical clock mechanisms.

Figure 6:
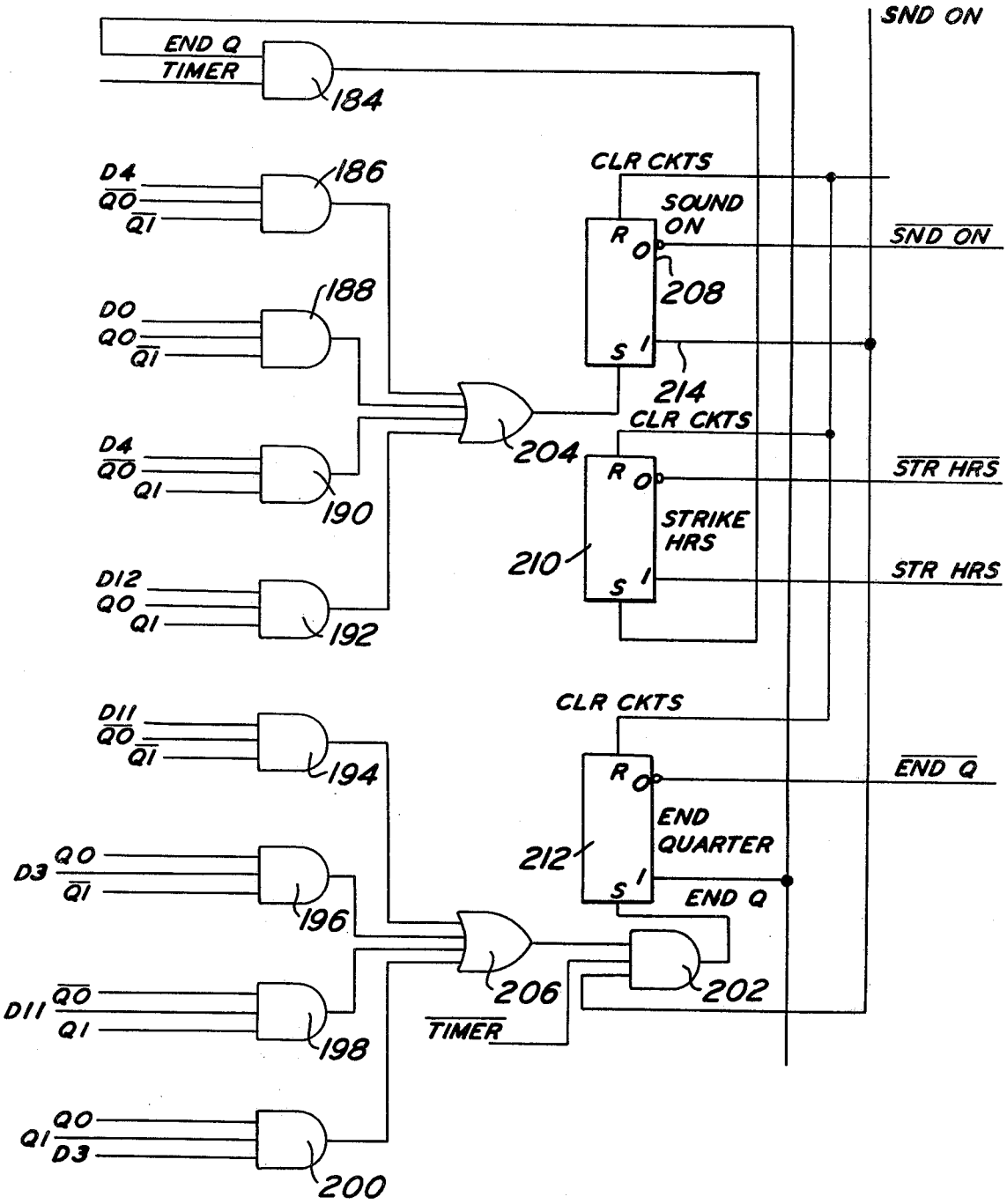
FIG. 6 is a schematic block diagram of the sound control.

Referring back to FIG. 2, it can be seen that the H0, H1, H2 and H3 lines of clock 20 are connected to comparator 38. The Q0 and Q1 lines of clock 20, as will hereinafter be seen, are utilized for the sound control which is shown in FIG. 6 and the ST CHIME output is connected to the ST CHIME line which, as will also be hereinafter seen, is connected to circuitry in the power and clearing control circuitry shown in FIG. 3.

In addition to the four input lines from the clock 20, comparator 38 also includes four input lines which are connected to the output lines HC0, HC1, HC2 and HC3 of the hour counter 36. The HC0 through HC3 lines of the hour counter 36 represent the outputs of the $2^0$ through $2^3$ stages of the hour counter 36 which is preferably a four stage binary counter. The count input of the hour counter 36 is connected to the output of AND gate 74. The inputs to AND gate 74 are connected to the timer line which is connected to the output of the timing control 24 in FIG. 4 and the END Q line which is connected to the true output line of the END Q flip flop of the sound control shown in FIG. 6. The inputs to OR gate 72 are the CLR CNTR and the CLR CKTS lines which are also connected to the power and clearing control shown in FIG. 3.

The output of OR gate 72 is connected to the reset of both the hour counter 36 and the chime counter 26. The chime counter 26 includes five output lines which are respectively labelled CC0 through CC4 and which represent the output lines in each of the five stages of the binary counter which comprises the chime counter 26.

An AND gate 76 having an output which is connected to the count input of chime counter 26 includes a pair of inputs from the TIMER line and the $\overline{\text{END Q}}$ line. It should be noted that when the bar is located over a term it means the inverted binary state of the symbol over which the bar is provided. Thus, in the case of the END Q line, the $\overline{\text{END Q}}$ label represents a line which will always have the inverted signal thereon. Thus, if the signal on the $\overline{\text{END Q}}$ line is high, the signal on the END Q line is low and vice versa.

The output lines CC0 through CC4 of the chime counter 26 are connected to the decoder shown in FIG. 5.

Figure 3:
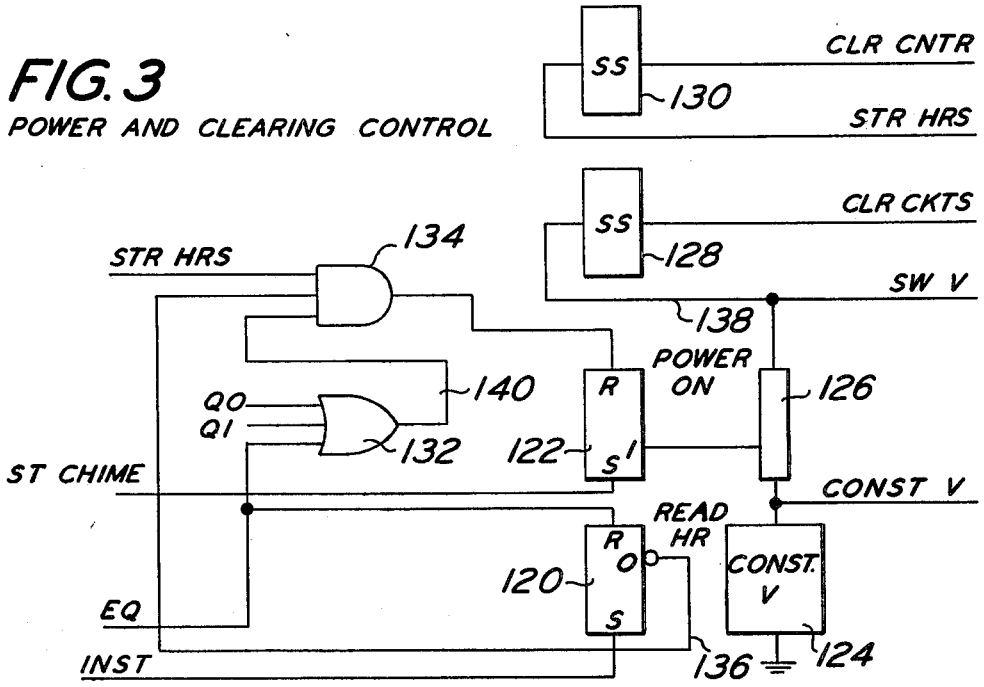
FIG. 3 is a schematic block diagram of the power and clearing control.

Referring to FIG. 3, it can be seen that the control 22 includes a power and clearing control having a pair of flip flops 120 (READ HR) and 122 (POWER ON), a constant voltage source 124 (CONST.V), an analog switch 126, a pair of single shot mutlivibrators 128 and 130, an OR gate 132 and an AND gate 134. READ HR flip flop 120 has connected to its set input the INST line which is connected via the contact 78 of switch 70 in FIG. 2 to the positive voltage source.

The reset input line of flip flop 120 is connected to the EQ line at the output of comparator 38 in FIG. 2. The inverted output of flip flop 120 is connected to line 136, which is connected to an input of AND gate 134. The set input of the POWER ON flip flop 122 is connected to the ST CHIME line which is connected to the ST CHIME output of clock 20 and to the positive voltage via contact plate 80 of switch 70 in FIG. 2.

The reset input of flip flop 122 is connected to the output of AND gate 134. The true output line of the power on flip flop 122 is connected to the control input of the analog switch 126. The constant voltage source 124 is connected at one end to ground and at its other end to the input of analog switch 126. The output of analog switch 126 is connected to the input of single shot multivibrator 128 via line 138 and via the SW V line to all of the circuits in the quarter hour and hour tone generator that are turned off to save power at the end of the operation of the chimes. They are turned on when the operation is started and off again when finished. Other circuits that must be on all the time are powered from the CONST V line.

As soon as voltage is applied to the single shot multivibrator 128, a pulse is provided on the output thereof which is the CLR CKTS line which clears both the hour counter 36 and the chime counter 26 in FIG. 2 and resets most flip flops. The single shot multivibrator 130 includes an input which is connected to the STR HRS line which is connected to the output of the strike hours flip flop shown in FIG. 6, and when the STR HRS line goes high, the single shot multivibrator 130 produces an output pulse on the CLR CNTR line which is connected to the OR gate 72 in FIG. 2 to clear both the chime counter and the hour counter when a pulse is provided thereon.

OR gate 132 includes three inputs. The first is connected to the EQ line from the comparator 38 in FIG. 2 and the other two to the output lines Q0 and Q1 from the clock 20 in FIG. 2. The outpout of OR gate 132 is connected via line 140 to an input of AND gate 134. The remaining inputs to AND gate 134 are the STR HRS line from the strike hours flip flop 210 in FIG. 6 and line 136 from the read hour flip flop 120. The output of AND gate 134 is connected to the reset input of flip flop 122.

The timing control is shown in FIG. 4 and includes a multivibrator 142 which includes a plurality of analog switches 141, 144, 146, 148 and 150 and a plurality of variable resistors 143, 152, 154, 156 and 158. The timing control also includes AND gates 160 and 162 and OR gate 164. The analog switches 141, 144, 146, 148 and 150 are connected to the feed-back loop of the multivibrator and enable variances of the frequency of pulses provided by the multivibrator on the output line labelled TIMER and the inverted output line labelled $\overline{\text{TIMER}}$. The output pulses on the TIMER line and the inverted pulses on the TIMER line control the sequence of sounds and the timing between the sounds produced by the tone generator 32. The active portion of the multivibrator 142 is connected at one end of the analog switches 141, 144, 146 and 148 via line 166. The other ends of analog switches 141, 144 and 146 are connected to the active portion of multivibrator 142 via variable resistors 143, 152 and 154. The other end of analog switch 148 is connected via resistor 156 to the junction between variable resistor 158 and the output of analog switch 150. In addition, the output of analog switch 148 is connected to the input of analog switch 150. The output of analog switch 150 is connected via the variable resistor 158 to the active portion of multivibrator 142. The control input of analog switch 141 is connected to the $\overline{\text{SND ON}}$ line which is the inverted output line of the sound on flip flip of FIG. 6. The control input of analog switch 144 is connected to the END Q line which is the output of the END Q flip flop and the sound control shown in FIG. 6.

The control input to analog switch 146 is connected to the output of AND gate 160 via line 168. The control input of analog switch 148 is connected from the output of AND gate 162 via line 170. The control input of analog switch 150 is connected to the output of AND gate 162 via line 170.

The AND gate 160 includes a pair of inputs, one of which is connected to the END Q line and the other of which is connected to the $\overline{\text{STR HRS}}$ line. The output of the AND gate 160, as set forth above, is connected to the control input of analog switch 146 via line 168. The AND gate 162 includes a pair of inputs, one of which is connected from the $\overline{\text{END Q}}$ line and the other of which is connected from the $\overline{\text{STR HRS}}$ line. The output of the AND gate 162, as set forth above, is connected to the control input of analog switch 148 via line 170. OR gate 164 includes four inputs connected from the output lines D3, D7, D11 and D15 of the decoder 28 in FIG. 5. The output of OR gate 164 is an inverted output which means that the signal on the output line is normally high unless any of the inputs to OR gate 164 go high, thereby causing the output signal to go low. The output of OR gate 164 is connected to the HOLD line which is connected to the control input of analog switch 150 and to the input of the tone generator in FIG. 8. As will hereinafter be seen in greater detail, the timing control is used to provide the pulses on the TIMER line from the multivibrator 142, which controls the timing sequence of the tones generated by the tone generator. The frequency of the pulses generated by the multivibrator 142 is controlled by the path between line 166 and the various analog switches and resistors which act to change the time constant of the multivibrator and therefore change the spacing between pulses as well as the oscillation rate for the generation of pulses on the TIMER line.

The decoding circuitry is shown in FIG. 5 and basically comprises a conventional decoder 28 which converts a four bit binary signal provided to its inputs A, B, C and D to a one out of sixteen signal provided on one of its output lines D0 through D15. The decoder circuitry also includes an OR gate 172, an AND gate 174 and an AND gate 176. The decoder 28 has connected to its inputs A and B output lines CC0 and CC1 from the chime counter 26 in FIG. 2. The input C of the decoder is connected to output line 178 of AND gate 176 and the D input of decoder 28 is connected to line 180 which is the output of OR gate 172.

The input to OR gate 172 is connected to the CC3 line from the chime counter 26 and the other input is connected to the output of AND gate 174, which is connected thereto via line 182. The inputs to AND gate 174 are the CC4 line and the CC2 line from the chime counter 26. The inputs to AND gate 176 are the CC5 line and the CC2 lines from the chime counter 26. The output of AND gate 176 is connected via line 178 to the C input of decoder 28.

As will hereinafter be seen in greater detail, the input signals to the decoder follow the output signals of line CC0, CC1, CC2 and CC3 of chime counter 26 up to the count of fifteen and the decoder converts the binary count in the chime counter to a signal on one of the fifteen output lines D0 through D15. Thus, a count of zero in the chime counter will produce a high signal on line D0 and a low signal on the remaining lines D1 through D15. A count of five in the chime counter, which in binary code would be 101, would cause a high signal on output line D5 of the decoder and a low signal on the remaining output lines. The gates 172, 174 and 176 are provided to enable a change of tones selected in sequence without requiring a decoder that can convert to a one out of N code, where N is greater than sixteen. This will be explained in greater detail hereinafter.

The sound control is shown in FIG. 6. The sound control basically comprises a plurality of AND gates 184, 186, 188, 190, 192, 194, 196, 198, 200 and 202, a pair of OR gates 204 and 206 and three flip flops 208, 210 and 212. The AND gate 184 has a pair of inputs which are connected to the END Q line from the output of flip flop 212 and to the TIMER output line of multivibrator 142. The AND gate 186 includes three input lines which are connected respectively to the D4 line of the decoder 28 in FIG. 5, the $\overline{Q0}$ line from clock 20 and the Q1 line from clock 20.

It should be noted that where a $\overline{Q}$ is shown as connected to one of the AND gates, the signal is preferably taken from the inverted output of the stage of the clock which produces the true Q output. Thus, the $\overline{Q0}$ output would be taken from a $2^0$ stage of the divide by four counter 90 in FIG. 9. The $\overline{Q0}$ input to AND gate 186 may also be taken from the Q0 output of the clock and inverted by an inverter.

AND gate 188 has its three inputs connected to the D0 line from the decoder, the Q0 line from the clock 20 and the $\overline{Q1}$ line from the clock 20. AND gate 190 has its inputs connected to the D4 output line of the decoder, the $\overline{Q0}$ and the Q1 line. The three inputs to AND gate 192 are connected to the output line D12 of the decoder and the Q0 and Q1 output lines of the clock 20. Each of the output lines of AND gates 186 through 192 are connected to one of the inputs of OR gate 204.

AND gate 194 has connected to its three inputs the output line D11 of the decoder and the $\overline{Q0}$ and $\overline{Q1}$ lines of the clock 20. The AND gate 196 has its three inputs connected to the Q0 and $\overline{Q1}$ output lines of the clock and the D3 output line of the decoder. The AND gate 198 has its three inputs connected to the $\overline{Q0}$ and Q1 outputs of the clock and the D11 output lines of the decoder. AND gate 200 has its four inputs connected, respectively, to the Q0 and Q1 output lines of the clock and the output lines of the decoder. Each of the outputs of AND gates 194, 196, 198 and 200 are connected to one of the inputs of OR gate 206.

The output of OR gate 204 is connected to the set input of flip flop 208 and to the reset of flip flop 210. The output of OR gate 206 is connected to one of the inputs of AND gate 202, the output of which is connected to the set input of flip flop 212. AND gate 202 also includes an input which is connected to output line 214 of flip flop 208 and a third input which is connected to the $\overline{TIMER}$ line. The $\overline{TIMER}$ line is connected to the inverted output line of multivibrator 142.

Flip flop 208 is labelled the sound on flip flop and has its reset input connected to the CLR CKTS line from the power and clearing control circuitry in FIG. 3 and specifically the output of single shot multivibrator 128. The output line 214 of the sound on flip flop 208 is connected to the SND ON line which, as will hereinafter be seen, enables the tones to be generated.

The flip flop 210 is labelled the strike hours flip flop. It has its reset input connected to the CLR CKTS line from the single shot multivibrator 128 in FIG. 3. It enables the generation of the hour chimes which are generated at each hour of the clock. The strike hours flip flop 210 has an output line from its inverted output labelled $\overline{STR\ HRS}$ and a true output labelled STR HRS. The set input of the flip flop 210 is connected to the output of AND gate 184. The flip flop 212 is labelled the end quarter flip flop and, as will hereinafter be seen, initiates the end of the chime cycle and controls whether the chime counter or hour counter is stepped by pulses from the timing control. The end quarter flip flop has a reset line which is connected to the CLR CKTS line from the single shot multivibrator 128 in FIG. 3. The set line is connected to the output of AND gate 202 and the TRUE and inverted outputs of flip flop 212 are respectively labelled END Q and $\overline{END\ Q}$.

As will hereinafter be seen in greater detail, the sound control enables, in combination with the decoder, the turning on of the sound and the selection of the tone sequence in accordance with the particular quarter hour and enables the generation of the hour chimes on the strike hours signal (at the hour).

Figure 7:
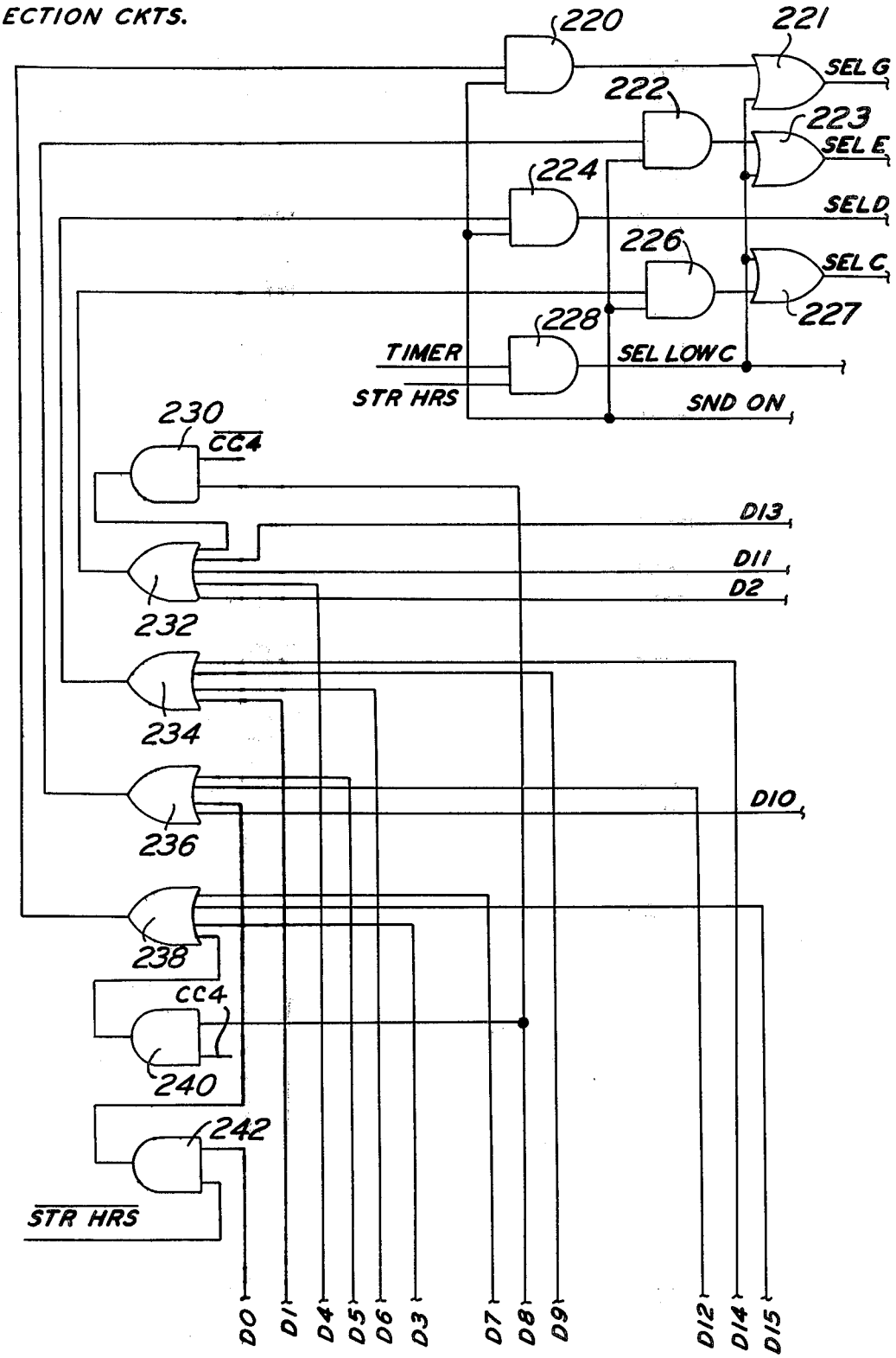
FIG. 7 is a schematic block diagram of the tone selection circuits.

The specific tones which are selected with the decoder and the sound control, is a result of the tone selection circuit shown in FIG. 7. The selection circuits include a plurality of AND gates 220, 222, 224, 226 and 228, the outputs of which are utilized to select the various tones which are produced by the tone generator. These gates are enabled in accordance with the plurality of gates in the lower portion of FIG. 7, including AND gate 230, OR gate 232, OR gate 234, OR gate 236, OR gate 238 and AND gates 240 and 242.

The output of AND gate 220 is connected to the SEL G line. The output of AND gate 222 is connected to the SEL E line, the output of AND gate 224 is connected to the SEL D line, the output of AND gate 226 is connected to the SEL C line and the output of AND Gate 228 is connected to the SEL LOW C line.

One input to each of gates 220 through 226 is connected to the SND ON line from the sound on flip flop 208 in FIG. 6. The remaining input to AND gate 220 is connected to the output of OR gate 238. The remaining input of AND gate 222 is connected to the output of OR gate 236, the remaining input of AND gate 224 is connected to the output of OR gate 234. The remaining input of AND gate 226 is connected to the output of OR gate 232. The inputs to AND gate 228 are the TIMER line and the STR HRS line from the multivibrator in FIG. 4 and the strike hours flip flop 210 in FIG. 6, respectively. The inputs to AND gate 230 are the $\overline{CC4}$ line and the D8 line, respectively. The output of AND gate 230 is connected to an input of OR gate 232.

The inputs of OR gate 232 are connected to the D2, D4, D11 and D13 output lines of the decoder 28 in FIG. 5. The inputs of OR gate 234 are connected to the D1, D6, D9 and D14 lines from the output of the decoder. The inputs of OR gate 236 are connected to the output of AND gate 242, line D5, line D10 and line D12 from the output of the decoder 28. The inputs to OR gate 238 are connected to the output of AND gate 240 and the D3, D7 and D15 lines of the decoder. The inputs of AND gate 240 are connected to the CC4 line from counter 26 and to the D8 line from the decoder. The inputs to AND gate 242 are connected to the $\overline{\text{STR HRS}}$ line and the D0 line from the decoder.

As will hereinafter be seen in greater detail, the selection circuits in FIG. 7 select the tones in accordance with the predetermined portion of the chime cycle that is reached, as indicated in the decoder 28. Thus, as a high signal is provided on the lines D0 through D15, various ones of the notes G, E, D, and C are selected in accordance with the logic of the selection circuits.

At this point it should be noted that the selection circuits are connected in accordance with the logic necessary to generate the set of chime sequences known as the Westminster Chimes.

The Westminster Chimes consist of the following four sets of sequences of tones and intervals corresponding to the quarters of the hour:

WESTMINISTER CHIMES

| | | | | | | | | | | | | | | | | | |
|---|---|---|---|---|---|---|---|---|---|---|---|---|---|---|---|---|---|
| 1ST QUARTER | | | | | | | | | | | | | | | | | |
| TONE | E | | | | | | | | | | | | | | | | |
| | | D | | | | | | | | | | | | | | | |
| | | | C | | | | | | | | | | | | | | |
| | | | | G | | | | | | | | | | | | | |
| COUNT | 0 | 1 | 2 | 3 | | | | | | | | | | | | | |
| 2ND QUARTER | | | | | | | | | | | | | | | | | |
| TONE | | E | | | | | | E | | | | | | | | | |
| | | | D | | | D | | | | | | | | | | | |
| | C | | | G | C | | | | C | | | | | | | | |
| COUNT | 4 | 5 | 6 | 7 | 8 | 9 | 10 | 11 | | | | | | | | | |
| 3RD QUARTER | | | | | | | | | | | | | | | | | |
| | | | | | | | | | | E | | | | | | | |
| TONE | E | | | | | | E | | | | D | | | | | | |
| | | | D | | | D | | | | | | | C | | | | |
| | | C | | G | G | | | C | | | | | | G | | | |
| COUNT | 12 | 13 | 14 | 15 | 16 | 17 | 18 | 19 | 20 | 21 | 22 | 23 | | | | | |
| 4TH QUARTER | | | | | | | | | | | | | | | | | |
| TONE | | E | | | | | E | | E | | | | | | | E | |
| | | | D | | | D | | | | | | D | | | D | | |
| | C | | | | C | | | | | C | | | | | | | |
| | | | | G | | | | C | | | | G | G | | | | C |
| COUNT | 4 | 5 | 6 | 7 | 8 | 9 | 10 | 11 | 12 | 13 | 14 | 15 | 16 | 17 | 18 | | 19 |

It should be noted that the intervals between each of the tones are all equal except for those after each group of four tones. The resistance of the timing circuit of the multivibrator 142 is increased after each four pulses from the multivibrator to generate the proper interval between each four pulses of the multivibrator by adding into the serial path from line 166 through the analog switches 148 and 150 and resistor 158, the resistor 156. Resistor 156 is normally shorted out by the conductive switch 150. When the switch 150 is made non-conductive by the enabling of gate 164, the increased resistance increases the interval between each group of four pulses.

The tone generator for simulating the chimes is shown in FIG. 8. The tone generator in FIG. 8 includes a plurality of individual tone generators 250, 252, 254, 256 and 258, which respectively generate signals of the frequencies of the tones G, E, D, C, and low C. The circuitry further includes a plurality of modulators 260, 262, 264, 266 and 268, each of which is connected to the output of one of the tone generators 250 through 258, respectively.

Five single shot multivibrators 270, 272, 274, 276 and 278 and five tone switch control five flip flops 280, 282, 284, 286 and 288 are also provided. The output of the multivibrators 270 through 278 are each connected to a control input of the modulators 260 through 268. The input to single shot multivibrator 270 is the SEL G line which is also connected to the set input of of flip flop 280. The input to single shot multivibrator 272 is the SEL E line which is connected to the set input of flip flop 282. The input to single shot multivibrator 274 is the SEL D line which is connected also to the set input of flip flop 284. The input to single shot multivibrator 276 is the SEL C line which is also connected to the set input of flip flop 286 and the input to single shot multivibrator 278 is the SEL LOW C line which is also connected to the set input of flip flop 288.

The circuitry also includes, in addition to the tone switch control flip flops 280 through 288, the five analog switches 290, 292, 294, 296 and 298. The outputs of modulators 260 through 268 are connected to the inputs of the analog switches 290 through 298, respectively. The output of the analog switches 290 through 298 are each connected to an input of a mixing amplifier 300. The output of amplifier 300 is connected to a speaker 302 which comprises the audio output.

The analog switches 290 through 298 each have a control input which is connected to the true output of the flip flops 280 through 288. The analog switches thus pass the signal provided from the output of the modulator when the input signal to the control input of the analog switch is high. Thus, when a flip flop associated with one of the analog switches is set by one of the select signals on lines SEL G through SEL LOW C, the setting of the flip flop enables the analog switch to pass the tone to the mixing amplifier 300. The HOLD line is connected to the trigger input (C) of each of the flip flops 280 through 286. Connected to the (D) input of each of flip flops 280 through 286 is a line connected to ground.

The single shot multivibrators 270 through 278 are provided to shape the output of the modulators 260 through 268 so that the output from the tone generators is not a constant amplitude tone, but rather is high in amplitude to start and then exponentially decays with time to simulate the sound of a chime. The envelope of the tone is thus modulated to the shape of a spike having exponential decay. Thus, if a pulse is provided on the SEL G line, the single shot multivibrator generates a spike with exponential decay to the modulator 260. A tone G having the same shape as the spike is generated at the output line of the modulator 260 and is passed via the analog switch 290 which has been made conductive by the setting of flip flop 280 by the pulse on the SEL G line. The analog switch continues to conduct the exponentially decaying tone until the signal on the HOLD line goes high and thereby causes the change in state of flip flop 280 as the leading edge on the HOLD line causes a triggering of the state of the flip flop 280 to follow the state of the voltage applied to the (D) input. Thus, the flip flop 280 remains in the set state until the HOLD line goes high.

As will hereinafter be seen, the signal on the HOLD line goes high only after the fourth tone of each sequence of tones is generated so that there is a blending of the tones in each of the sequences of four tones of the Westminster Chimes. The mixing amplifier 300 accepts the signals provided on each of the output lines from the analog switches 290 to 298 and amplifies the same to drive the speaker 302 which converts the electronic signal into sounds equivalent to the Westminster Chimes.

Power is provided to the system by the constant voltage source 124. For purposes of clarity, the various interconnections for power have not been shown. The constant voltage source is connected at all times to the timepiece or clock 20, where it is an electrically operated clock, the power on flip flop 122 and the analog switch 126. To conserve energy, so that a portable battery source may be utilized as the constant voltage source, power is provided to the portions of the circuitry that do not have to be powered between quarters via the output line SW V from the analog switch 126.

OPERATION OF THE SYSTEM

The intervals for the tones generated are controlled by the multivibrator 142 in the timing control of FIG. 4. As set forth above, the intervals between tones are all equal, except for those after each group of four tones. The multivibrator 142, however, has various speeds of operation, as well as intervals inserted between chime sequences in accordance with the various resistors 143, 152, 154, 156 and 158, which are switched into and out of the multivibrator circuit by the opening and closing of the various analog switches 141, 144, 146 148 and 150.

The highest oscillation speed of the multivibrator 142 occurs at the initiation of the chime sequence since the $\overline{\text{SND ON}}$ line is high, indicating that the sound circuitry has not been activated. Until the SND ON signal goes high, resistor 143 is connected into the circuit by the analog switch 141, which is made conductive by the high signal on the $\overline{\text{SND ON}}$ line. The low resistance of resistor 143 causes short time intervals between the pulses generated by the multivibrator 142 and thereby causes the highest pulse rate while the output of the system is silent.

As soon as the sound flip flop is set, the $\overline{\text{SND ON}}$ line goes low and thereby causes the normal resistance to be provided across the multivibrator through resistor 158. It should be noted that the analog switch 150 is normally conductive as a result of the OR gate 164 having an inverted output, as indicated by the circle which causes the output to be high unless the OR gate 164 is enabled. Thus, the resistance across the multivibrator 142 goes from line 160 through analog switch 148, through analog switch 150, which shorts across the resistor 156, and through the resistor 158. Thus, the normal resistance in the multivibrator during the generation of the Westminster Chimes is resistor 158.

In order to increase the interval of time between each sequence of four chimes, as the fourth tone of each group of four tones are generated, the output line of the decoder 28, for that particular count, the D3, D7, D11 or D15 line goes high and enables OR gate 164 which causes the inverted output of OR gate 164 to go low thereby causing analog switch 150 to be nonconductive and thereby causing resistor 156 to be inserted into the multivibrator circuit.

As the resistance is increased across the multivibrator circuit, the length of the interval between pulses is also increased. As soon as the next pulse from the multivibrator on the TIMER line is generated, the chime counter is stepped to the next count. This causes the output line of the decoder for the previous count that is connected to OR gate 164 to go low and thereby causes OR gate 164 to be disabled and analog switch 150 to be made conductive, thereby causing a lowering of the resistance across the multivibrator circuit 142, which decreases the interval between pulses. Thus, after each four pulses, the interval is increased.

Another time when the interval is different is during the fourth quarter after the four sequences of chimes are generated and before the hour chimes are struck. When the end quarter flip flop is set, a high signal is provided on the END Q line and a low signal on the $\overline{\text{END Q}}$ line. This disables AND gate 161 which thereby causes analog switch 148 to become nonconductive thereby disconnecting resistances 154 and 158 from the multivibrator. At the same time, the signal on the END Q line is high and the $\overline{\text{STR HRS}}$ signal is also high, AND gate 160 is enabled which thereby causes analog switch 146 to be conductive thereby inserting into the multivibrator circuit resistance 154. The insertion of resistance 154 changes the interval between the last quarter hour chime and the first tone for the striking of the hour. When the striking hours flip flop is set shortly thereafter, AND gate 160 is disabled. However, the STR HRS line goes high thereby making analog switch 144 conductive as analog switch 146 becomes nonconductive and thereby causes resistor 152 to determine the intervals between each of the hour chimes.

One further explanatory note before describing the overall operation is that while the Q0 and Q1 output lines of clock 20 represent the various quarters of an hour, it should be noted that when both Q0 and Q1 are low, the clock 20 is at the hour. Thus, when Q0 and Q1 are both low it represents the fourth quarter of the Westminster Chimes. The period when Q0 is high and Q1 is low represents the first quarter, the period when Q0 is low and Q1 is high represents the second quarter and the period when both Q0 and Q1 are high, represents the third quarter hour.

The system shown in FIG. 1 and FIGS. 2 through 10 basically includes two modes of operation. In the first mode of operation, chimes are generated as the timepiece or clock 20 reaches fifteen minutes past the hour, thirty minutes past the hour, forty-five minutes past the hour and the hour. The sequence of tones which is generated by the system are those set forth above in the Westminster chime chart. The second mode of operation is the instantaneous readout which enables pushbutton 70 shown in FIG. 2 to be pressed and thereby cause generating tones in accordance with the quarter hour and hour shown in the clock 20.

In the first mode of operation wherein the Westminster Chimes are generated at the quarters of an hour, the simplest of the chime sequences is the first quarter of an hour sequence. That is, referring to the Westminster Chime chart on pages 22 and 23, the notes E, D, C, and G are generated on the counts of zero through three. The counts below the tones in the chart represent the count in chime counter 26. Thus, when the clock 20 in FIG. 2 reaches the point of the first quarter of an hour, fifteen minutes past the hour, a pulse is provided on the ST CHIME line and the outputs of the Q0 and Q1 line are high and low, respectively.

The pulse on the ST CHIME line causes the power on flip flop 122 in FIG. 3 to be set, thereby causing the analog switch 126 to become conductive and enables the power supply to be provided to the remainder of the circuitry via the SW V line. The high output signal on line 138 from the analog switch from the constant voltage source 124 also causes a pulse to be provided by the single shot multivibrator 128 which is applied to the CLR CKTS line. The pulse on the CLR CKTS line causes the chime counter 26 and the hour counter 36 to be reset to zero and the sound on flip flop 208, the strike hours flip flop 210 and the end quarter flip flop 212 in FIG. 6 and the tone switch control flip flops 280 through 288 in FIG. 8 to be reset.

As soon as the chime counter 26 is reset, the output on each of lines CC0 through CC4 is low, thereby indicating a count of zero which causes the decoder 28 to produce a high signal on the D0 line. In this respect it should be noted that as long as the output on line CC4 from the decoder is low, the outputs on the CC0, Cc1 and CC2 and CC3 are applied to the inputs A, B, C and D of the decoder 28. Thus, during the first sixteen counts of the chime counter (i.e., from count zero through fifteen) the input signals applied to the A, B, C and D inputs of the decoder 28 represent the counts of zero through fifteen and thereby causes the output signals on lines D0 through D15 to be sequentially made high as the counter is stepped from zero to fifteen.

The D0 line having a high signal, in combination with the signals on the $\overline{Q0}$ line being high and the Q1 line being high, causes AND gate 188 in FIG. 6 to be enabled which thereby causes the sound on flip flop 208 to be set via OR gate 204. The signal on the output line SND ON goes high and the signal on the $\overline{\text{SND ON}}$ line goes low.

AND gate 242 in FIG. 7 is enabled by the high signals on the $\overline{\text{STR HRS}}$ line and the D0 line from the decoder. The enabling of AND gate 242 causes a high signal to be applied to the input of OR gate 236 thereby enabling OR gate 236 and causing AND gate 222 to be enabled with the high pulse from the OR gate 238 and the high signal provided on the SND ON line from the sound on flip flop, thereby providing a high signal to OR gate 223 to enable it to provide a high signal on the SEL E line.

Referring to FIG. 8, it can be seen that the signal on the SEL E line going high causes the flip flop 282 to be set and a pulse to be generated by single shot multivibrator 272. The pulse from the single shot multivibrator enables the modulator 262 to pass the chime shaped tone from tone generator E through the analog switch 292 which has been made conductive by the setting of flip flop 282 to the mixing amplifier 300 which causes speaker 302 to generate the sound of the E chime of the Westminster Chimes. Multivibrator 142 then generates pulse one on the TIMER line which causes the chime counter 26 to be stepped to the count of one via gate 76 which is enabled by the pulse on the TIMER line and the high signal on the $\overline{\text{END Q}}$ line from the end quarter flip flop 212 which has been reset by the CLR CKTS line which is pulsed at the initiation of the chime cycle.

The count of one in the chime counter is converted to a high signal on the D1 line of the decoder which goes high as D0 goes low.

As seen in FIG. 7, the D1 line is connected to OR gate 234 which is thereby enabled by the signal going high and thereby enables AND gate 224 which provides a high signal on the SEL D line. The high signal on the SEL D line causes the single shot multivibrator 274 in FIG. 8 to generate a spike pulse which causes the modulator 264 to pass the signal from the tone generator D to the analog switch 294 which has been made conductive by the setting of flip flop 284 when the SEL D line goes high.

The spike-shaped tone signal is provided to the mixing amplifier 300 which amplifies the D tone which is mixed with the substantially reduced sound of the previous tone E and transmitted to the audio output speaker 302 to generate the second tone of the Westminster Chimes.

The multivibrator 142 then generates the next pulse which causes the chime counter 26 in FIG. 2 to be stepped to the count of two and, accordingly, the decoder 28 converts the count of two in the chime counter to a high signal on line D2, thereby lowering the signal on line D1. As seen in FIG. 7, the D2 line is connected to the input of OR gate 232 which is enabled and thereby causes AND gate 226 to be enabled, thereby causing OR gate 227 to be enabled, thereby causing a high signal on the SEL C line. The high signal on the SEL C line causes single shot multivibrator 276 to generate a spike to modulator 266 and sets flip flop 286. The modulator 266 then transmits a spike shaped tone from tone generator 256 to the analog switch 296 which conducts the signal to the mixing amplifier 300 which provides the spike shaped tone from tone generator 256 to the speaker 302 which provides the sound of a chime of tone C with the background of tones E and D which have both been reduced exponentially with time.

The next pulse of multivibrator 142 in FIG. 4 causes the chime counter 26 to be set to the count of three which thereby causes a high signal on the D3 output line of decoder 28, which, as seen in FIG. 7, causes AND gate 238 to be enabled and thereby enables AND gate 220 to enable OR gate 221 to provide a high signal on the SEL G line. The high signal on the SEL G line causes the single shot multivibrator 270 in FIG. 8 to generate a spike pulse and flip flop 280 is set. The modulator 260 thus produces a signal on its output line which has an envelope of a spike to the analog switch 290 which passes a signal to the mixing amplifier 300 which thereby produces on the output thereof a signal which causes the speaker 302 to produce a chime sound with the tone G having the background of each of tones E, D, and C, which have exponentially faded as a result of the low signal at the control inputs of the modulators 262, 264 and 266.

It should be noted that when line D3 went high upon receipt of the pulse from the multivibrator to produce the last tone, the OR gate 164 was enabled and thereby caused analog switch 150 in FIG. 4 to be nonconductive and thereby caused the resistor 156 to be placed in series with resistor 158 in the multivibrator circuit 142. This increased the duration of the interval between pulses three and four, that is, the pulses that produce the count of three and four in the chime counter. The high signal on line D3 also enables AND gate 196 in FIG. 6. AND gate 196 was primed at the initiation of the chime cycle to be enabled by a high signal on the line D3 since the outputs of lines Q0 and $\overline{Q1}$ were high. Thus, when a pulse is received by the chime counter and converted into a high signal on line D3 of the decoder, the AND gate 196 is enabled.

The enabling of AND gate 196 causes the enabling of OR gate 206 which in turn primes AND gate 202 to be enabled to set end quarter flip flop 212 as the $\overline{\text{TIMER}}$ line goes high when pulse three goes off. AND gate 202 already has a high signal from the true output of sound on flip flop 208. The flip flop 208 was previously set by the enabling of AND gate 188 and OR gate 204.

At the beginning of pulse four from the multivibrator 142, the chime counter 26 is stepped to the count of four and thereby causes line D3 to go low, which thereby disables OR gate 164. When the OR gate 164 is disabled, the HOLD line goes high, which thereby causes, in FIG. 8, the resetting of each of the flip flops 280 through 286 which are switched to the reset state on the leading edge of a pulse to the trigger input of the flip flops. When flip flops 280 through 286 are reset, the signal to the control input of analog switches 290 to 296 goes low and thereby cuts off all sound to the audio output speaker 302 as the switches become nonconductive.

When the end quarter flip flop 212 is set by the enabling of AND gate 202, the END Q line goes high. This primes AND gate 184 to be enabled when the TIMER line goes high at the beginning of pulse four which steps the chime counter to the count of four. When AND gate 184 is enabled, the strike hours flip flop 210 is set and thereby causes the signal on the STR HRS line to go high, which enables AND gate 134 (FIG. 3) which resets the power on flip flop 122 and thereby causes analog switch 126 to be made nonconductive thereby causing a turn-off of power to the entire portion of the circuit which is not used between the chime cycles. Thus, the mixing amplifier 300 and speaker 302 are turned off immediately upon the chime counter being stepped to the count of four.

It should be noted that the remianing signals to the inputs of AND gate 134 were high as a result of the output of the read hour flip flop 120 being reset and the output line 136 of which is high. The remaining input signal on line 140 of AND gate 134 is high as a result of the Q0 line being high which enables OR gate 132 at the initiation of the first quarter chime cycle.

The circuitry remains quiescent until the clock 20 reaches thirty minutes past the hour, at which time a pulse is generated on the ST CHIME line and the signal Q0 goes low and the Q1 signal goes high. The high signal on the ST CHIME line causes the power on flip flop 122 in FIG. 3 to be set, and thereby causes the analog switch 126 to become conductive and enable the power supply to supply power to the remainder of the circuitry and to provide an initiating input signal to the single shot multivibrator 128. The resulting pulse on the CLR CKTS line causes a resetting of the chime counter 26, the hour counter 36, the sound on flip flop 208, the strike hours flip flop 210, the end quarter flip flop 212 and the tone switching control flip flops 280 through 288.

At this point it should be noted that AND gate 190 is the only one of gates 186, 188, 190 and 192 which can be enabled when Q0 is low and Q1 is high. Thus, AND gate 190 cannot be enabled until pulse four has been generated by the multivibrator 142 on the TIMER line. Accordingly, the sound on flip flop remains reset and thereby provides the $\overline{\text{SND ON}}$ line with a high signal which causes the analog switch 141 in the timing control to be conductive thereby providing in parallel the resistor 143 which is of low resistance and there by causes a short period between each of the pulses generated by the multivibrator 142. The pulses on the TIMER line quickly step the chime counter 26 through the count of one, two and three. Pulses four steps the counter to four. As soon as the count in the chime counter 26 reaches the count of four, the decoder line D4 goes high which causes gate 190 in FIG. 6 to be enabled which enables OR gate 204 and sets the sound on flip flop 208. The high signal on line D4 also causes OR gate 238 in FIG. 7 to be enabled which causes AND gate 220 to be enabled, as a result of the high signal on the SND ON line when the sound on flip flop 208 is set, thereby providing a high signal to OR gate 221 which in turn provides a high signal on the SEL G line.

Referring to FIG. 8, the high signal on the SEL G line causes the setting of flip flop 280 and a pulse from the multivibrator 270 which causes the tone G to be applied via the mixing amplifier 300 to the speaker 302 to provide the first chime of the second quarter sequence of chimes shown in the chart on pages 22 and 23.

When the next pulse from the multivibrator 142 is generated on the TIMER line, the chime counter is stepped to the count of five thereby providing a high signal on line D5 of the decoder which causes the enabling of OR gate 236 and AND gate 222 and OR gate 223. The SEL E line going high causes the flip flop 282 to be set and a pulse from single shot multivibrator 272 which enables the modulator to pass its tone E to the speaker 302. The next pulse in the multivibrator 142 causes the chime counter to be stepped to the count of six which causes the D6 line to go high and thereby causes OR gate 234 and AND gate 224 to be enabled. The high signal on the SEL D line also causes the generation of the tone D which is passed to the speaker 302. The next multivibrator pulse causes the chime counter to be stepped to the count of seven which causes D7 to go high and OR gate 238 and AND gate 220 and OR gate 221 are enabled thereby causing the SEL G line to go high and the generation of the tone G from speaker 302.

When the count of seven is reached in the chime counter 26, line D7 goes high thereby enabling OR gate 164 which causes the HOLD line to go low, which in turn causes the analog switch 150 to become nonconductive and thereby inserts the resistor 156 in series with resistor 158 in the multivibrator circuit 142. Thus, a longer interval is provided between pulses seven and eight to give a greater spacing between the next pulse and the previous four pulses and thereby creates the spacing of the sequence of tones as indicated to be required in the Westminster Chimes.

As soon as pulse eight is generated by the multivibrator 142, the chime counter is stepped to the count of eight which causes the line D7 to go low turning off OR gate 164 thereby causing the HOLD line to go high which resets each of the flip flops 280 through 286 (FIG. 8) to enable the sound to be cut off completely prior to the generation of the next four tones. The D8 line then goes high causing AND gate 230 to be enabled since the $\overline{CC4}$ line is low because the count has not reached sixteen in the chime counter 26.

The enabling of AND gate 230 causes the enabling of OR gate 232 which enables AND gate 226 to provide a high signal on the SEL C line which in turn causes the generation of the C tone to the speaker 302. On pulses nine, ten and eleven from the multivibrator 142, the chime counter is stepped through the count of nine, ten and eleven, respectively, which causes the OR gates 234, 236 and 232 to be energized sequentially which causes the generation of the D, E and C tones respectively in that order at the output speaker 302. When the D, E and C tones are generated, the previous tones in the group of four tones are mixed in their reduced condition with the tone struck to form the background tones. Line D3 being high causes AND gate 198 in FIG. 6 to be enabled which causes the enabling of OR gate 206 which provides a high signal to AND gate 202. Since the sound on flip flop 208 has previously been set, the second input of AND gate 202 also being high primes AND gate 202 to be enabled to set the end quarter flip flop 212 by the $\overline{TIMER}$ line going high as pulse eleven goes off.

When the end quarter flip flop 212 is set, the END Q signal going high primes AND gate 184 to be enabled to set the strike hours flip flop 210 when the TIMER line goes high at the beginning of pulse twelve. The setting of the strike hours flip flop provides an enabling signal to AND gate 134 in FIG. 3 which, along with the high signals from the read hour flip flop 120 and the high signal on line 140 from the OR gate 132, enables AND gate 134 and resets the power on flip flop 122 to turn off the circuitry via analog switch 126.

The third chime sequence is initiated at forty-five minutes past the hour, at which time the ST CHIME line goes high thereby setting the power on flip flop 122 to turn on the circuitry again. At the third quarter of an hour, the outputs from clock 20 on the Q0 and Q1 lines respectively are both high. Thus, AND gates 192 and 200 in FIG. 6 are controlled by the high signals on Q0 and Q1 so that AND gate 192 is enabled when line D12 goes high and AND gate 200 is enabled whenever line D3 goes high. However, since the sound on flip flop 208 is reset and remains so until the chime counter reaches the count of twelve, a low signal remains on the SND ON line till then. Therefore, when AND gate 200 is enabled by the D3 line, the first time the chime counter reaches the count of three, AND gate 202 remains disabled and flip flop 212 remains in the reset state.

Referring back to the Westminster Chimes chart on pages 22 and 23 supra, the first sequence of four notes starts on count twleve through fifteen. Thus, since the sound on flip flop remains in the reset state through the count of eleven in the chime counter, the first twelve pulses of the multivibrator are generated with short intervals between each of the pulses as a result of the analog switch 141 being conductive and thereby inserting into the multivibrator circuit the low resistance 143.

Upon pulse twelve from the multivibrator 142 on the TIMER line, the chime counter reaches the count of twelve which thereby provides a high signal on the line D12 of the decoder 28. The high signal on line D12 causes AND gate 192 in FIG. 6 to be enabled thereby setting the sound on flip flop. The high signal on line D12 also causes OR gate 236 (FIG. 7) to be enabled which enables AND gate 222 to enable the generation of the first tone E from the output speaker 302.

During pulses thirteen, fourteen and fifteen from the multivibrator, the count in the chime counter is stepped respectively to counts thirteen, fourteen and fifteen, which cause the generation of tones C, D and G as lines D13, D14 and D15, respectively, receive high signals. When the count of fifteen is reached line D15 goes high enable OR gate 164 to turn off analog switch 15 a longer interval between pulses fifteen and sixteen from the timer and thereby causing the spacing between the first four tones and the second four tones of the sequence.

When the chime counter 26 reaches the count of sixteen, the CC4 line goes high which causes a change in the sequence of the high signals on the output lines of the decoder 28. That is, the second sequence of tones in the third quarter hour are similar to the second sequence of tones in the second quarter hour, with the exception of the first note which is a G instead of a C. Also, the sequential high signals on D0 through D3 normally produce the sequential tones E, D, C, G as set forth above with respect to the first quarter chimes. Thus, to change the sequence in accordance with the requirements of the Westminster Chimes, the CC4 line, in combination with the OR gate 172 and AND gates 174 and 176, enables the generation of tones G, D, E and C during the counts of sixteen, seventeen, eighteen and nineteen in the chime counter. That is, when the count of sixteen is reached in the chime counter, CC4 goes high and each of the lines CC0 through CC3 go low. The input signals to lines A, B, C and D of decoder 28 during the count of sixteen are thus low, low, low and high, respectively, which is equivalent to binary 8 and therefore D8 is high.

Because the signal on the CC4 line is high and therefore the signal on the $\overline{CC4}$ line is low, AND gate 240 in FIG. 7 is enabled by the high signal on line D8 and not AND gate 230. When AND gate 240 is enabled, OR gate 238 is enabled thereby enabling AND gate 220 to enable OR gate 221 to provide the SEL G signal to generate the tone G during pulse sixteen. The next multivibrator pulse steps the count in the chime counter to the count of seventeen which causes CC0 to go high thereby providing a high signal to input A of decoder 28, CC1 remains low and thereby provides a low signal to the B input of decoder 28. As best understood with respect to FIG. 5, the low signal on line CC2 continues to enable AND gate 174 in combination with the high signal on line CC4 which causes OR gate 172 to provide a high signal to input D of the decoder. These inputs are equivalent to the binary count of 9 and thereby causes the D9 line to go high, which causes OR gate 234 to be enabled which enables AND gate 224 which causes the high signal on the SEL D line which in turn causes the generation of tone D.

The next pulse from the multivibrator steps the chime counter to the count of eighteen.

When the chime counter 26 is stepped to the count of eighteen, the CC4 line remains high, the CC0 line goes low, the CC1 line goes high and the CC2 and CC3 lines remain low. Thus, a low signal is provided to the A input of decoder 28, a high input is provided to the B input of the decoder 28, AND gate 176 remains disabled, thereby providing a low signal to input C. The AND gate 174 remains enabled thereby enabling OR gate 172 and providing a high input to the D input of decoder 28 which effectively provides the count of ten to the decoder 28. This causes output line D10 to go high thereby enabling OR gate 236 in FIG. 7 and in turn AND gate 222 which enables OR gate 223 which causes the SEL E line to go high which in turn enables the tone generator to generate the tone E.

The multivibrator then generates the next pulse which steps the chime counter to the count of nineteen which causes CC0 to go high while CC1 remains high. CC2 and CC3 remain low and CC4 remains high. The input lines to A, B, C and D inputs of decoder 28 thereby go high, high, low and high, respectively, or provide the equivalent of the count of eleven thereby causing output line D11 to go high which enables AND gate 232 in FIG. 7.

The enabling of OR gate 232 causes AND gate 226 to be enabled which causes a high signal on the SEL C line causing the tone of C to be generated by the speaker 302. Line D11 going high also enables the OR gate 164 in FIG. 4, thereby causing resistor 156 to be placed in serial with resistor 158 in the multivibrator circuit and thereby increases the interval of time between the previous pulse and the next pulse and thereby provides a spacing between the second and third group of four tones in the third quarter sequence.

The next pulse from the multivibrator steps the chime counter to the count of twenty. When the count of twenty is reached, the CC0 and CC1 lines are both low, the CC2 line is high, the the CC3 line is low and the CC4 line is high. Accordingly, a low input is provided to the A and D inputs of the decoder 28. AND gate 176 remains disabled because the CC4 line is high and thereby provides another low input to the C input of decoder 28. AND gate 174 is disabled and, since CC3 is low, OR gate 172 remains disabled thereby providing a low input to the D input of decoder 28 and thereby providing the effective count of zero to the decoder 28. Accordingly, when the signal on the D0 line goes high at the count of twenty in the chime counter, it causes AND gate 242 to be enabled which in turn enables OR gate 236 and AND gate 222 which causes the SEL E line to go high. The E tone is thus generated at the beginning of the third group of four tones. The next pulse from the multivibrator changes the count in the chime counter to twenty-one which causes a high input to input A of decoder 28 while B, C and D remain low, thereby effectively providing the count of one which is resultant in a high signal on line D1. This enables OR gate 234 and AND gate 224 which produces a high signal on line SEL D which causes the generation of the D tone.

The next multivibrator pulse causes the chime counter to be stepped to the count of twenty-two which leaves output lines CC2, CC3 and CC4 unchanged, but causes a change in the output signals on lines CC0 and CC1 so that the signal on line CC0 is low and the signal on line CC1 is high. This effectively provides the count of two to the decoder at its inputs A, B, C and D which causes line D2 to go high and which causes the generation of the C tone via gates 226 and 232.

The next multivibrator pulse steps the chime counter to the count of twenty-three which causes only output line CC0 to change from a low to a high and thereby causes a high, high, low, low input respectively to inputs A, D, C and D to the decoder 28. The equivalent input of the count of three causes line D3 to go high which causes the selection of tone G via the AND gate 220 and OR gate 238.

Line D3 being high enables OR gate 164 which causes a longer interval between the previous pulse and the next pulse from the multivibrator. Line D3 being high again enables AND gate 200 in FIG. 6. The enabling of AND gate 200 in turn causes OR gate 206 to be enabled. Since the SND ON line is high this time, the enabling of OR gate 206 primes AND gate 202 to be enabled to set the end quarter flip flop 212 when the $\overline{\text{TIMER}}$ line goes high as pulse twenty-three goes off. The setting of the end quarter flip flop 212 causes AND gate 184 to be enabled to set the strike hours flip flop 210 when the signal on the TIMER line goes high as pulse twenty-four goes on. When flip flop 210 is set, the STR HRS Line goes high and causes AND gate 134 in FIG. 3 to be enabled and thereby reset flip flop 122 which turns off the power and thereby ends the third quarter hour sequence.

The circuit remains quiescent until the next quarter of an hour is passed, at which time the hour point is reached in clock 20.

Assuming that the clock has reached four o'clock, the ST CHIME line goes high from clock 20 in FIG. 2 and causes the power on flip flop 122 to be set and thereby turns on the power again to the circuitry. The single shot multivibrator 128 generates the pulse on the CLR CKTS line which resets the sound on flip flop, the strike hours flip flop, the end quarter flip flop, the tone switching control flip flops and the chime and hour counters.

It should be noted that at the hour the Q0 and Q1 lines are both low and thus gates 186 and 194 in FIG. 6 are primed to be enabled when the signals on line D4 and D11 go high, respectively. Since the sound on flip flop 208 is reset, the $\overline{\text{SND ON}}$ line has a high signal thereon which causes the multivibrator to generate four pulses quickly and to step the chime counter to the count of four. When the chime counter reaches the count of four, the decoder 28 provides a high signal on the line D4 which enables AND gate 186, which in turn enables OR gate 204 to set the sound on flip flop 208.

The high signal on line D4 also causes the generation of the C tone via AND gate 226 and OR gate 232. When the multivibrator generates the next pulse, the count in the chime counter is stepped to five thereby causing the D5 line to go high, which causes the generation of the E tone via AND gate 222 and OR gate 236 in FIG. 7. Similarly, during the next two pulses from the multivibrator, the count in the chime counter is stepped to six and seven and the D and G tones are generated as set forth above.

When the count of seven has been reached in the chime counter, line D7 goes high enabling OR gate 164, thereby causing the multivibrator to have a greater interval inserted between pulses seven and eight to provide spacing between the first sequence of tones and the second sequence of tones. During pulses eight, nine, ten and eleven from the multivibrator 142, the second sequence of tones C, D, E, C of the fourth quarter hour Westminster chimes are generated and similarlty a greater interval is provided between pulses eleven and twelve from the multivibrator in order to provide a larger space between the second and third groups of four tones.

During pulses twelve through fifteen from the multivibrator, the tones E, C, D and G are generated.

When pulse sixteen is generated by the multivibrator, the chime counter is stepped to the count of sixteen which thereby causes the decoder to receive via gates 172, 174 and 176 the effective binary counts of eight, nine, ten and eleven during pulses sixteen, seventeen, eighteen and nineteen from the multivibrator. As set forth above with respect to the second group of four tones of the third quarter hour chimes, this causes the generation of tones G, D, E and C during pulses sixteen, seventeen, eighteen and nineteen from the multivibrator.

When the count of nineteen has been stepped into the chime counter, the output lines CC0, CC1 and CC4 are each high while output lines CC2 and CC3 are low, which causes the decoder to receive via gates 172, 174 and 176 the effective binary count of eleven. Accordingly, line D11 from decoder 28 goes high and causes the generation of the C tone. Line D11 being high also enables OR gate 164 to cause the analog switch 150 to become nonconductive, inserting the resistor 156 in series with resistor 158. This acts to increase the interval between pulses nineteen and twenty generated by the multivibrator.

Line D11 being high also enables AND gate 194 (FIG. 6) which in turn enables OR gate 206. Also, since the sound on flip flop 208 is set and the SND ON line is high, AND gate 202 is enabled to set the end quarter flip flop 212 as soon as the $\overline{\text{TIMER}}$ line goes high when pulse nineteen from the multivibrator goes low. When the end quarter flip flop 212 is set, the AND gate 184 receives a high signal on the END Q line. This allows the next TIMER pulse from multivibrator 142 to set the strike hours flip flop 210. When the STR HRS line goes high as a result of the setting of flip flop 210, AND gate 134 in the power and clearing control of FIG. 3 receives the high signal, but is not enabled because of the fact that OR gate 132 remains disable since both Q0 and Q1 are low during the fourth quarter of an hour. Accordingly, instead of terminating the cycle after the four groups of tones are generated, the hour striking sequence is started.

The high signal on the STR HRS line also causes single shot multivibrator 130 in FIG. 3 to generate a pulse which resets both the chime counter 26 and the hour counter 36 via OR gate 72 in FIG. 2. Thus, the hour counter is reset to zero at the initiation of the strike hours cycle.

The hour striking sequence is controlled by the end quarter flip flop 212 in FIG. 6 and the strike hours flip flop 210. The output of the end quarter flip flop is provided on the END Q line to AND gate 74 associated with the hour counter 36 in FIG. 2. Because the $\overline{\text{END Q}}$ line from the end quarter flip flop goes low, AND gate 76 associated with the chime counter goes low and AND gate 76 is thereby disabled and prevents the timer pulses from being counted by the chime counter 26. The hour counter thus receives each of the succeeding pulses from the multivibrator. It should be noted that the multivibrator intervals are now controlled by the STR HRS line which has gone high, and thereby causes the resistor 152 to be switched into the multivibrator circuit in place of resistor 158. This causes longer intervals between the timing pulses of the multivibrator for the hour chime. Also, in FIG. 7, the high signal on the D0 line from decoder 28 as a result of the count of zero in the chime counter does not enable AND gate 242 because the signal on the $\overline{\text{STR HRS}}$ line is low during the hour striking sequence.

The next pulse of the multivibrator steps the hour counter 36 from zero to one. The timer pulse is also provided to gate 228 in FIG. 7 which, in combination with the high signal on the STR HRS line, enables gate 228 which provides a high signal on the SEL LOW C line. The high signal on the SEL LOW C line also enables OR gates 221, 223 and 227 to provide a high signal on the SEL G, SEL E and SEL C lines as well. These signals going high cause in FIG. 8 the firing of the single shot multivibrators 270, 272, 276, as well as 278, and the setting of flip flops 280, 282, 286, as well as 288. The single shot multivibrators each produce spiked pulses to produce longer exponentially decaying spike pulses during the strike hours cycle. The outer envelopes of the tones produced by the modulators are spike-shaped and are transferred via the conductive analog switches to the mixer amplifier 300 and is then amplified to produce the mixed sound in speaker 302.

Each timer pulse produced by the multivibrator 142 then produces an addtional high signal on the SEL LOW C line as well as stepping up the hour counter 36. After the fourth timer pulse has been generated by the multivibrator 142, the hour counter reaches the count of four. Thus, the output lines HC0, HC1, HC2 and HC3 are respectively low, low, high and low. The outputs from the clock on lines H0 through H3 are also low, low, high, low, respectively, and therefore when the hour counter reaches the count of four, the comparator 38 produces a positive pulse on the EQ line. The high signal on the EQ line enables the OR gate 132 in FIG. 3 which produces a high signal on line 140 which enables AND gate 134 to reset the power on flip flop 122 and thereby turn off the circuitry.

It should therefore be noted that at each hour point reached by clock 20, the fourth quarter chime tones are succeeded by the hour chimes which are produced by each timer pulse generated by the multivibrator. For each multivibrator pulse, the hour counter is stepped one count and when the number in the hour counter equals the clock readout which is indicative of the hour, the comparator produces a high signal on the EQ line which is then used to turn off the tone generating circuitry.

As set forth above, there is a second mode of operation of the circuit when the chimes are instantaneously activated, irrespective of the time, by pressing the button 70 shown in FIG. 2 which causes the signal on the INST line to go high, as well as the signal on the ST CHIME line. When the instantaneous readout is pressed, not only does the circuitry produce the first, second and third quarter chime tones during the first, second and third quarters of an hour, but the hour chime tones are also generated so that an instantaneous coded audible readout can be obtained to the most recently passed quarter of an hour.

Thus, assuming that the time is 3:20, when the push-button 70 is pressed, a high signal is provided on both the INST line and the ST CHIME line which causes the power on flip flop 122 in FIG. 3 to be set and the read hour flip flop 120 to be set. Accordingly, since the Q0 and Q lines are high and low respectively, since it is past fifteen minutes past the hour, the first quarter hour chimes E, D, C and G are generated by the circuit as set forth above with respect to the first quarter in the first mode of operation. However, when AND gate 196 is enabled upon pulse four to the chime counter and the end quarter flip flop is set which allows the strike hours flip flop to be set via AND gate 184, at the end of pulse four when the $\overline{\text{TIMER}}$ line goes high. AND gate 134 is not enabled by the high signal on the STR HRS line because the signal on line 136 from the read hour flip flop 120 is low.

Accordingly, the multivibrator 142 stays on and continues to produce pulses which are fed to the hour counter since the end quarter flip flop is set and the signal on the $\overline{\text{END Q}}$ line is high while the signals on END Q line goes low. AND gate 228 enables the pulses on the TIMER line to generate the low C sound to represent each of the hour chimes. When the hour counter has reached the count of three, the comparator 38 receives the same signals on lines HC0 through HC3 as were provided on lines H0 through H3 of clock 20 and thereby provides a high signal on the EQ line which resets the read hour flip flop 120 and provides a high signal to OR gate 132. The output of OR gate 132 thus goes high as does the line 136 from the read hour flip flop and thereby enables AND gate 134 to reset the power on flip flop 122 and turn off the circuitry.

Accordingly, if the user is familiar with the sequences of chimes generated by the chime generator during each quarter hour, the user knows that it is a time between 3:15 and 3:30 based on the one sequence of chimes followed by the hour chimes.

It should also be understood that a more discrete readout can be provided by utilizing a clock 20 that not only provides hour and quarter of an hour signals, but also provides signals representative of the minute of the hour so that a coded sound signal can be provided representative of each hour and minute of the day.

The instantaneous readout provides a convenient way of determining the approximate time by a soothing chime readout without requiring turning on the lights to see the dial of the clock. With a more discrete readout, the clock has application for use as a clock for the blind or persons of reduced sight.

Without further elaboration, the foregoing will so fully illustrate our invention that others may, by applying current or future knowledge, readily adapt the same for use under various conditions of service.

What is claimed as the invention is:

1. An electronic tone generator system for generating sequences of tones in accordance with the time of day, said system including a timepiece having output means for providing a coded signal representative of the time, means responsive to said output means for generating a sequence of electronic tones each time said means responsive is activated, said means responsive being activated each quarter hour, said tones being converted to a sound which is an audible representation of the time said chime generator generating a first sequence of tones at the first quarter hour, a second sequence of tones at the second quarter hour, a third sequence of tones at the third quarter hour and a fourth sequence of tones at the hour, said generator further generating a chime of a different tone than the previous tones at the hour for each hour of the day past 12 o'clock.

2. An electronic tone generator system for generating sequences of tones in accordance with the time of day, said system including a timepiece having output means for providing a coded signal representative of the time, means responsive to said output means for generating a sequence of electronic tones each time said means responsive is activated, said tones being converted to a sound which is an audible representation of the time, said means responsive to said output means including gating means for selecting a sequence of tones in accordance with the time represented by said output means.

3. A chime generator in combination with a timepiece, said timepiece having output means for providing a coded signal representative of the time of day, said chime generator including an on/off circuit for turning on said chime generator in response to an input signal, timing control means for generating timing pulses, counting means connected to said timing control for counting said pulses, selection means responsive to the count of said counting means and said output means for sequentially generating signals, and a tone generator for generating a plurality of tones, said tone generator having an input means for enabling generation of each of said tones, said selection means being connected to said input means of said tone generator, said selection means providing a plurality of signals to said input means of said tone generator in predetermined sequences in accordance with the coded signal representative of said time each time said on/off circuit turns said chime generator on upon receipt of an input signal.

4. The combination of claim 3 wherein said timepiece includes means to generate an output signal each time said timepiece reaches a predetermined interval, said output signal being supplied as an input signal to said on/off circuit for turning on said chime generator at predetermined intervals.

5. The combination called for in claim 3 wherein said selection means includes a decoder having a plurality of output lines connected to the output of said counting means, the output lines of said decoder being connected to different ones of said inputs of said tone generator, said decoder causing the generation of different ones of said tones in sequence as said count in said counter is changed.

6. The combination of claim 5 wherein said selection means further includes a plurality of gates responsive to the output means of said timepiece for starting the generation of tones at predetermined counts in said counter in accordance with the time in said timepiece, said gates being responsive to different times in said timepiece so that the sequence of tones generated by said chime generator corresponds to the time in said timepiece.

7. The combination of claim 6 wherein said selection means further includes a plurality of gates each responsive to the count in said counter and said output means of said timepiece for turning off said on/off circuit so that said chime generator is turned off after a predetermined sequence of tones in accordance with the time in said timepiece.

8. The combination of claim 3 wherein said on/off circuit is turned on at predetermined intervals by signals generated by said timepiece.

9. The combination of claim 8 wherein said signals are generated by said timepiece at each quarter hour.

10. The combination of claim 9 wherein said chime generator generates a first sequence of four tones at the first quarter hour, two sequences of four tones at the second quarter hour, three sequences of four tones at the third quarter hour and four sequences of tones at the hour, said generator further generating a chime of a different tone than the previous tones at the hour for each hour of the day past 12 o'clock.

11. The combination of claim 10 and further including a manual initiation means for generating an instantaneous chime readout in accordance with the time of day wherein said chimes are generated in accordance with the quarter hour in which the chime generator is initiated followed by said hour chimes.

12. The combination of claim 3 wherein said tone generator includes a modulating means for shaping each tone generated by said tone generator to a spike output with an exponential decay.

13. The combination of claim 12 and further including a mixing amplifier, said mixing amplifier being connected to the output of said tone generator to enable mixing of tones in each sequence of four.

14. The combination of claim 13 wherein said tone generator is connected to said amplifier by electronic switches said switches being controlled by storage means, said storage means enabling said tones to be provided to said mixing amplifier until the end of each sequence of four tones.

* * * * *